US006220032B1

(12) United States Patent
Schmidt et al.

(10) Patent No.: US 6,220,032 B1
(45) Date of Patent: Apr. 24, 2001

(54) ENGINE BRAKING PROCESS FOR A SUPERCHARGED INTERNAL-COMBUSTION ENGINE

(75) Inventors: Erwin Schmidt, Baltmannsweiler; Siegfried Sumser, Stuttgart, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/406,847

(22) Filed: Sep. 29, 1999

(30) Foreign Application Priority Data

Sep. 29, 1998 (DE) ..... 198 44 573

(51) Int. Cl.[7] ..... F02D 23/00

(52) U.S. Cl. ..... 60/602; 123/322; 415/158; 415/164

(58) Field of Search ..... 60/602; 123/322; 415/158, 164

(56) References Cited

U.S. PATENT DOCUMENTS

| | | | | |
|---|---|---|---|---|
| 5,758,500 | * | 6/1998 | Sumser et al. | 60/602 |
| 5,813,231 | * | 9/1998 | Faletti et al. | 60/602 |
| 5,839,281 | * | 11/1998 | Sumser et al. | 60/602 |
| 5,967,115 | * | 10/1999 | Konopka et al. | 123/323 |
| 6,050,775 | * | 4/2000 | Erdmann et al. | 415/164 |
| 6,102,146 | * | 8/2000 | Schmidt et al. | 60/602 |

FOREIGN PATENT DOCUMENTS

| | | | |
|---|---|---|---|
| 196 37 999 | 3/1998 | (DE) . | |
| 197 50 331 | 5/1998 | (DE) . | |
| 197 27 141 | 8/1998 | (DE) . | |
| WO 95/26466 | 10/1995 | (WO) | 60/602 |

* cited by examiner

*Primary Examiner*—Thomas Denion
*Assistant Examiner*—Thai-Ba Trieu
(74) *Attorney, Agent, or Firm*—Evenson, McKeown, Edwards & Lenahan, P.L.L.C.

(57) ABSTRACT

In an engine braking operation for a supercharged internal-combustion engine which has an exhaust gas turbocharger having a turbine with a variable turbine geometry, the turbine geometry is adjusted between a ram position to reduce the effective turbine cross-section and an opening position to open the effective turbine cross-section. In order to influence the action of the engine brake simply, such that a braking is adapted to different situations, the variable turbine geometry is adjusted between a definable hard braking adjustment and a definable soft braking adjustment. The hard braking adjustment is situated between the ram position and a drive starting position assigned to the fired drive operating mode. The soft braking adjustment is situated between the drive starting position and the opening position. The hard braking adjustment is selected so that the engine braking power is higher than in the soft braking adjustment.

22 Claims, 2 Drawing Sheets

ENGINE BRAKING PROCESS FOR A SUPERCHARGED INTERNAL-COMBUSTION ENGINE

BACKGROUND OF THE INVENTION

This application claims the priority of 198 44 573.3-13, filed Sep. 29, 1998, the disclosure of which is expressly incorporated by reference herein.

The present invention relates to an engine braking process or operation for a supercharged internal-combustion engine, and more particularly, to an engine braking operation in which the engine has an exhaust gas turbocharger with a turbine with a variable turbine geometry which can be adjusted between a ram position with the smallest possible turbine cross-section and an opening position with the largest possible turbine cross-section.

DE 196 37 999 A1 discloses an internal-combustion engine which has an exhaust gas turbocharger having a turbine geometry which is variably adjustable by adjustable guide baffles. The guide baffles comprise guide blades which can be adjusted by an actuator to change the effective turbine cross-section of the turbine. As a result, depending on the operating condition of the internal-combustion engine, exhaust back pressures of different intensities can be implemented in the section between the cylinders and the turbine. Thereby, the power of the exhaust gas turbocharger can be adjusted according to the system requirements.

In order to achieve an engine braking effect in the braking operation of the internal-combustion engine, the guide baffles are changed into a ram position in which the turbine cross-section is reduced, whereby a high exhaust back pressure is built up. The exhaust gas flows at a high flow rate through the ducts between the guide blades and acts at a high impulse upon the turbine wheel. The turbine power is transmitted to the compressor. Thereupon, the combustion air fed to the engine is subjected to an increased charge pressure by the compressor.

As a result, the cylinder is acted upon on the input side by an increased pressure. On the output side, an increased exhaust back pressure exists between the cylinder outlet and the exhaust gas turbocharger. This exhaust back pressure counteracts the blowing-off of the air compressed in the cylinder into the exhaust gas pipe system. In the engine braking operation, during the compression stroke and push-out stroke, the piston must carry out compression work against the high excess pressure in the exhaust gas pipe system, whereby a strong braking effect is achieved.

SUMMARY OF THE INVENTION

An object of the present invention is to influence the action of the engine brake by simple measures so that a braking is possible which is adapted to different situations.

According to the present invention, this object has been achieved by a method in which in the engine braking operation, a permissible turbine cross-section band width within the range between the ram position and the opening position is defined for the adjustment of the variable turbine geometry. The turbine cross-section band width is bounded by a hard braking adjustment and a soft braking adjustment, which represent definable limit values. The hard braking adjustment is situated between the ram position and a drive starting position assigned to the fired drive operating mode, wherein the soft braking adjustment is situated between the drive starting position and the opening position, in the drive starting position. The turbine geometry in the fired drive operating mode assumes its smallest cross-section, in the hard braking adjustment, the engine braking power maximum is reached.

By defining two braking adjustments or braking positions of the variable turbine geometry, a band width is determined for the movement of the component influencing the effective turbine cross-section. Within this band width, the variable turbine geometry can take up different positions as a function of the actually existing situation. The hard and the soft braking adjustment mark limit values within the maximally possible positions, which are characterized by the ram position with a minimal turbine cross-section and the opening position with a maximal turbine cross-section.

The band width marked by the hard and the soft braking adjustment represents a cutout within the maximally possible positions of the turbine geometry limited by stops. In the hard braking adjustment, the effective turbine cross-section is further reduced than in the soft braking adjustment. Thereby, in the hard braking adjustment, a higher exhaust back pressure arises in the exhaust gas pipe system upstream of the turbine and a higher engine braking power can also be generated than in the softer braking adjustment. Arbitrary adjustments of the variable turbine geometry are conceivable between the two braking adjustments.

The hard braking adjustment and the soft braking adjustment are in a defined relationship with a starting position of the turbine geometry assigned to the fired driving operating mode. In the case of the fired drive, the turbine geometry assumes its smallest cross-section in the starting position in this operating mode. This cross-section, beginning from the starting position, is opened further with an increasing load or rotational speed. The turbine cross-section is normally opened further in the starting position than in the ram position.

According to the invention, the hard braking adjustment is now situated between the ram position with the smallest possible turbine cross-section and the starting position, and the soft braking adjustment is situated between the starting position and the opening position with the largest possible turbine cross-section. The two braking adjustments are therefore situated on this side and on the other side of the starting position for the fired operation.

As a result, on one hand, a sufficiently wide motion band is determined for the variable turbine geometry. This permits the generation of sufficiently high braking powers in the range of the hard braking adjustment. In addition, smaller engine braking powers in the range of the soft braking adjustment are permitted. On the other hand, the range of the adjusting path adjusting the variable turbine geometry is considerably reduced. It is sufficient to vary the adjustment of the variable turbine geometry in a smaller range which, however, includes the most important engine braking power sections. This has the advantage that a small adjusting path for the variable turbine geometry allows large changes of the engine braking power.

Because only relatively small adjusting paths must be applied, the turbine geometry can be adjusted between the different braking positions with low expenditures and within a short time. As a result, it is possible to rapidly react to new driving situations and influence the dynamic behavior of the vehicle.

If, for example, the turbine geometry is in the hard braking adjustment with a correspondingly high engine braking power, the charger will exhibit a fast response behavior. If the turbine geometry is in the soft braking adjustment with a correspondingly lower engine braking power, a uniform soft starting of the engine brake takes place, which results in lower forces onto the braked wheels and in smaller speed changes. In the case of a softer adjustment of the engine brake, a destabilizing wheel slip is avoided. In the case of a harder adjustment, maximal engine braking powers can be achieved. The change from the hard adjustment to the soft adjustment and vice-versa can be implemented with short adjusting paths and the lowest possible delay.

The starting position is expediently in the range of the largest gradient of the engine braking power—adjusting path curve. Slight changes in the adjusting path of the variable turbine geometry cause a maximal change in the engine braking power. The hard braking adjustment and the soft braking adjustment are situated on both sides of this point in the area with the high gradient, so that a large engine braking power spectrum can be covered by a short adjusting path.

The hard braking adjustment is situated in the engine braking power maximum which is situated close to the ram position while the opening of the turbine geometry is small. In the engine braking power maximum, a high exhaust back pressure is generated by the reduction of the effective turbine cross-section. Exhaust gas can flow at high flow rates through the open ducts of the turbine geometry and transmit a high flow impulse to the turbine wheel.

The softer braking adjustment is characterized by a lower engine braking power. The softer braking adjustment is preferably selected such that the engine braking power which can be reached in this adjustment is lower than in the ram position of the variable turbine geometry, in which an engine braking power is reached which is clearly below the maximum. The engine braking power in the softer adjustment amounts particularly to no more than 50% of the braking power in the hard adjustment. The braking power spectrum obtained with these adjustments is sufficient for providing the required engine braking power for all normally occurring driving situations.

In a further advantageous embodiment, the adjusting path, which is required for adjusting the variable turbine geometry from the hard braking adjustment to the starting position in the fired operation, is selected to be of the same size as the adjusting path which is required for the adjustment from the starting position to the soft braking position. This construction is distinguished by a symmetrical position of the driving starting position between the two braking adjustments, so that the same adjusting paths must be applied in each case from the driving starting position in the direction of both braking adjustments.

The decision concerning the engine braking power to be applied can be influenced by an automatic controller intervention. Different condition variables of the vehicle or other operating variables are used as the decision criterion, particularly the inclination of the road, the vehicle deceleration and the temperature of the wheel brakes. In cartrailer combinations, the thrust of the trailer upon the tractor can be taken into account as another influencing variable. These control quantities can be combined with a manual intervention, particularly defining of the speed in a cruise control function.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1A:
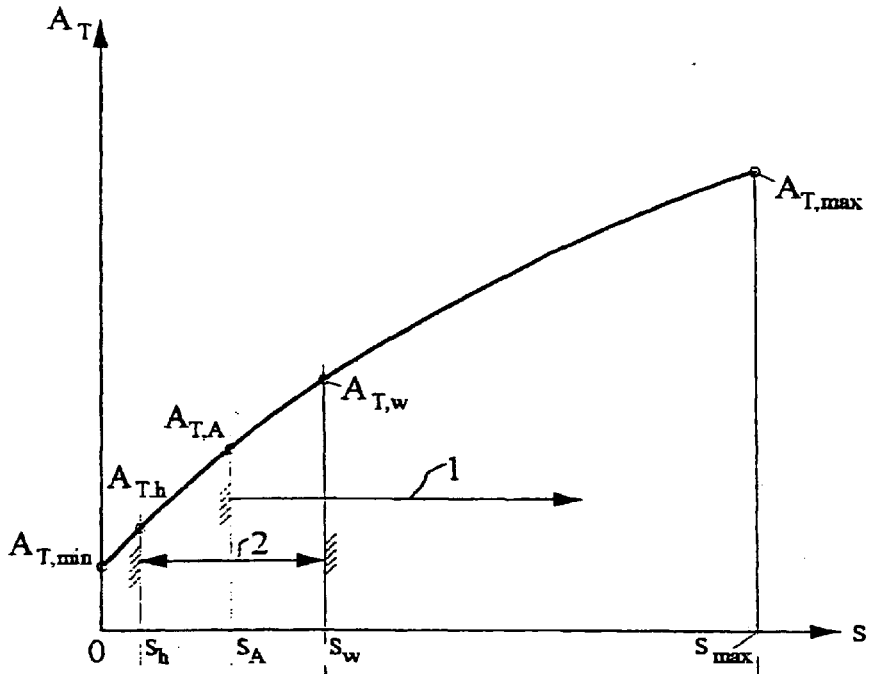
FIG. 1*a* is a diagram of the function of the effective turbine cross-section depending on the adjusting path of the variable turbine geometry, with indicated braking points.

The function illustrated in FIG. 1*a* shows the course of the effective turbine cross-section $A_T$ depending on the adjusting path s of an actuator which acts upon the variable turbine geometry in the exhaust gas turbine of an exhaust gas turbocharger. The turbine cross-section can be reduced to a minimum $A_{T,min}$ which corresponds to a ram position of the variable turbine geometry with an adjusting path s=0. Starting from the minimum $A_{T,min}$, the turbine cross-section $A_T$ rises constantly and continuously to a maximum $A_{T,max}$, which is reached in the case of the maximal adjusting path $s_{max}$ in the opening position of the variable turbine geometry. The function of the turbine cross-section $A_T$ rises degressively.

Directly adjacent to the ram position with the minimal flow cross-section $A_{T,min}$, a first point $A_{T,h}$ is marked which, in the following, is called a hard braking adjustment. The hard braking adjustment $A_{T,h}$ is reached in the case of an adjusting path $s_h$ of the actuator acting upon the variable turbine geometry. In the further course, in the case of an adjusting path $S_A$, a point $A_{T,A}$ is reached which marks a drive starting position of the turbine geometry in the fired driving operating mode. The drive starting position $A_{T,A}$ marks the point with the minimal flow cross-section on the curve starting from which the variable turbine geometry in the fired driving operation in the direction of the arrow 1 is adjusted in the direction of larger turbine cross-sections.

In the adjusting path $s_w$, a soft braking adjustment $A_{T,w}$ is reached. In the soft braking adjustment $A_{T,w}$, the turbine cross-section is opened further than in the drive starting position $A_{T,A}$, in which the turbine cross-section is again opened further than in the hard braking adjustment $A_{T,h}$.

The hard braking adjustment $A_{T,h}$, the drive starting position $A_{T,A}$ and the soft braking adjustment $A_{T,w}$ mark adjustable, definable points of the function of the turbine cross-section $A_T$ which can be stored or programmed in an automatic control and control unit of the internal-combustion engine. In the engine braking operation, the variable turbine geometry of the exhaust gas turbine can be adjusted only between the hard braking adjustment $A_{T,h}$ and the soft braking adjustment $A_{T,w}$. The range between the hard and the soft braking adjustment is marked by a braking band 2 within the maximally possible range between the turbine cross-section minimum $A_{T,min}$ and the turbine cross-section maximum $A_{T,max}$, the braking band 2 including the drive starting position $A_{T,A}$.

Figure 1B:
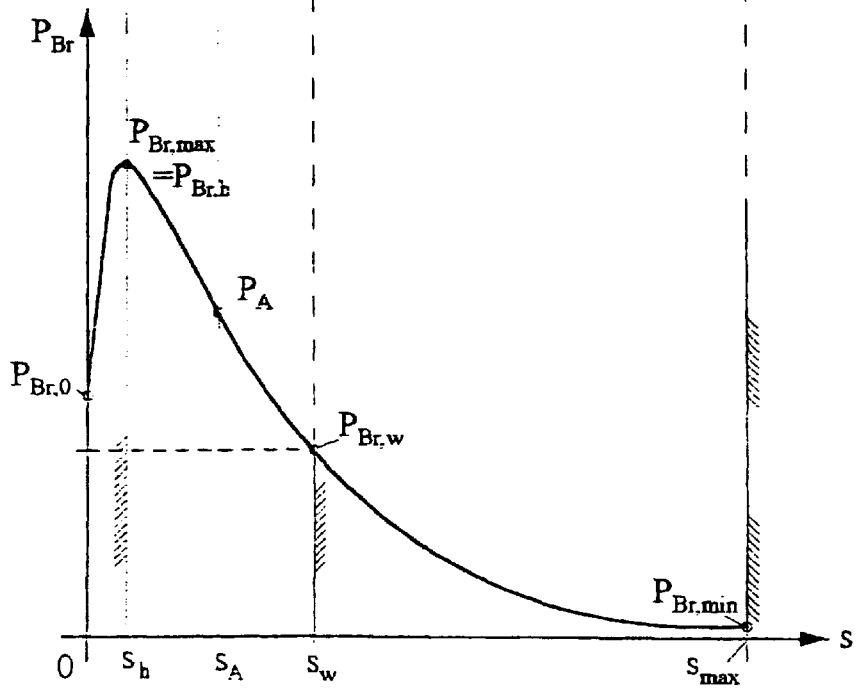
FIG. 1*b* is a diagram of the function of the engine braking power depending on the adjusting path of the variable turbine geometry.

The drive starting position $A_{T,A}$ is situated approximately in the center between the hard and the soft braking adjustment $A_{T,h}$ and $A_{T,w}$. The adjusting path between $s_h$ and $s_A$ has approximately the same size as the adjusting path between $a_A$ and The engine braking power curve $P_{Br}$ according to FIG. 1*b* is also indicated as a function of the adjusting path s. In the case of an adjusting path s=0 (the ram position of the variable turbine geometry), the starting engine braking power $M_{Br,0}$ assumes a middle value. In this point, the adjustable component of the variable turbine geometry is maximally closed. The remaining open flow ducts in the narrowest turbine cross-section only slightly permit a flowing-through of the retained exhaust gas for generating turbine power.

With the opening turbine geometry, while the adjusting path s increases, the engine braking power $M_{Br}$ rises very considerably up to a maximum $P_{Br,max}$, which, in the case of the adjusting path $s_h$, is reached with the pertaining braking adjustment $A_{T,h}$ (FIG. 1*a*). The reason for the rise of the engine braking power is the higher rate of air flow through the open flow ducts of the turbine geometry and the higher power transmitted to the turbine. The engine braking power maximum $P_{Br,max}$ is simultaneously the hard braking power $P_{Br,h}$ assigned to the hard braking adjustment. Subsequently, the engine braking power first drops steeply and, in the further course, falls more flatly to a minimal value $P_{Br,min}$, which is reached in the case of the maximally possible adjusting path $s_{max}$.

Between the engine braking power maximum $P_{Br,max}$ and the engine braking power minimum $P_{Br,min}$, two points $P_A$ and $P_{Br,w}$ are indicated in the assigned adjusting paths $s_A$ and $s_w$, which mark the starting driving power $P_A$ in the fired operation and the soft braking power $P_{Br,w}$ assigned to the soft braking adjustment. The starting driving power $P_A$ is situated in the center between the hard and the soft braking power $P_{Br,h}$ and $P_{Br,w}$ in the range of the largest gradient of the curve. The soft braking power $P_{Br,w}$ is situated slightly below the starting engine driving power $M_{Br,0}$. The soft braking power $P_{Br,w}$ amounts to maximally half the engine braking power maximum $P_{Br,max}$.

It may be expedient to displace the point of the soft braking power $P_{Br,w}$ closer in the direction of the starting driving power $P_A$ or closer in the direction of the engine braking power minimum $P_{Br,min}$. In a displacement in the direction of the starting driving power $P_A$, the adjusting path s for the adjustment of the variable turbine geometry between the hard and the soft adjustment is shortened. In a displacement in the direction of the engine braking power minimum $P_{Br,min}$, a larger engine braking power spectrum is covered.

Figure 2:
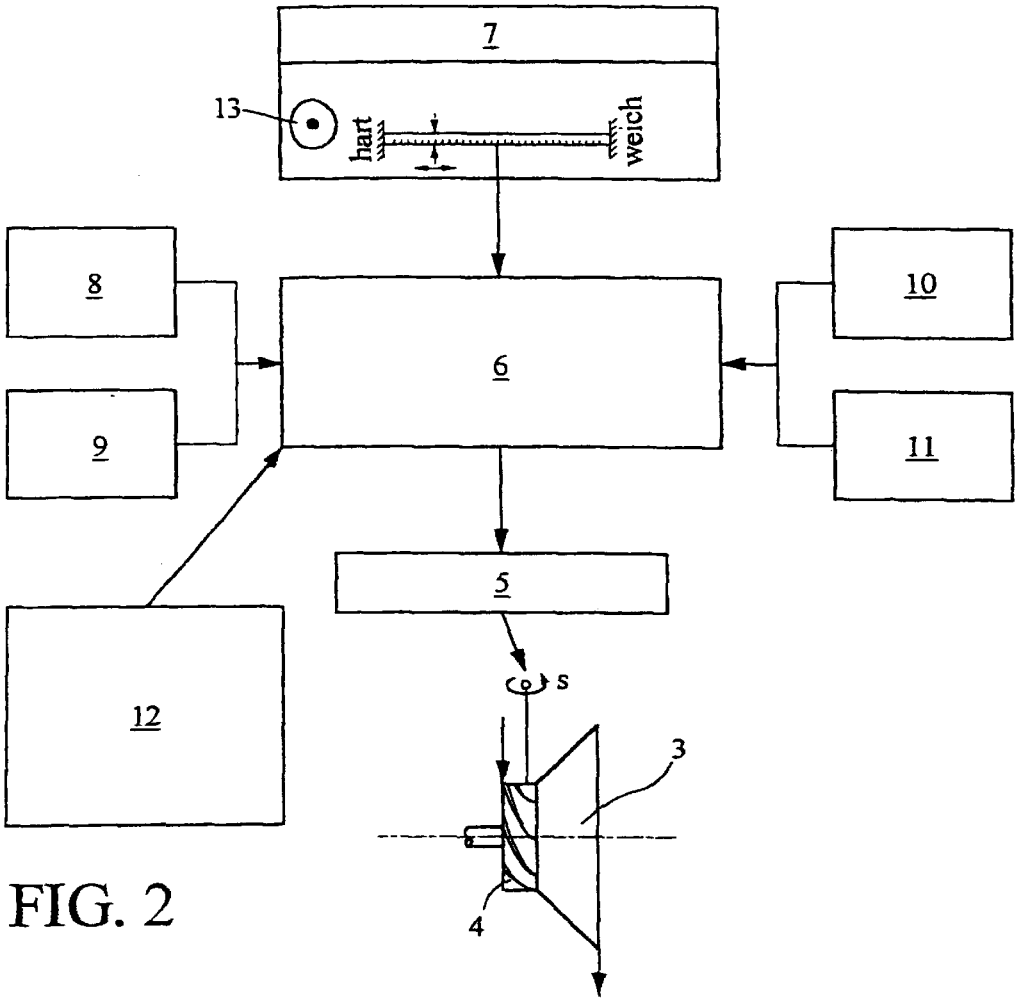
FIG. 2 is a schematic diagram of a turbine with a variable turbine geometry and the condition and operation variables influencing the geometry.

FIG. 2 is a schematic representation of an exhaust gas turbine 3 which is equipped with a variable turbine geometry 4 for the variable adjustment of the effective turbine cross-section. The variable turbine geometry 4, which is constructed, for example, as guide baffles with rotatable guide blades, is adjusted by an actuator 5 by the adjusting path s. The actuator 5, particularly an actuator which is to be operated electrically, receives adjusting signals from a controller 6, which receives information concerning the operating condition of the internal-combustion engine or of the vehicle as input signals and generates the adjusting signals from the input signals. The controller 6 communicates with diverse constructional units in which signals are generated or fed.

In a manual adjustment 7, the driver can continuously choose between a defined maximal hard (left) and a defined minimal soft (right) braking adjustment. The selected braking adjustment is fed for a further processing as the input signal to the controller 6. A manual input is not absolutely necessary. It may, for example, be expedient to cause the controller 6 to automatically determine an optimal value for the engine braking power. In the event of conflicts between a manual input and an optimal value computed by the controller 6, the controller value is preferred. The manual adjustment 7 can be switched on and off by way of a switch 13.

As further input signals, the actual road inclination measured by a gradient sensor 8; the actual thrust, particularly in the case of car-trailer combinations, measured by a thrust or force sensor 9; the actual deceleration measured by a deceleration sensor 10, and the actual temperature of the wheel brakes measured by a temperature sensor 11 are transmitted to the controller 6 as additional input signals. In a further unit 12, additional engine and vehicle operating variables, such as the rotational engine speed, the load, etc., are available and are transmitted to the controller 6 as input signals. From the input signals, the controller 6 computes in each case the optimal value of the engine braking power within the defined braking band.

Figure 3:
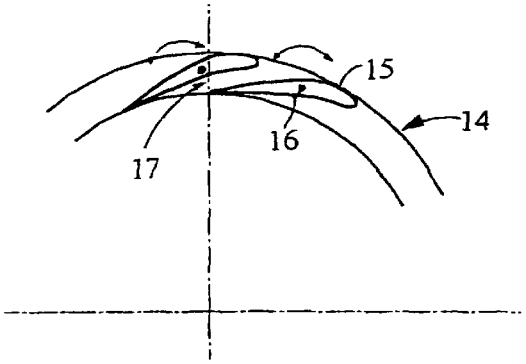
FIG. 3 is a view of a variable turbine geometry in the form of guide baffles with rotary blades.

FIG. 3 shows a variable turbine geometry constructed as guide baffles 14 with guide blades 15. The guide baffles 14 are situated in the turbine inlet cross-section of the exhaust gas turbine. As the result of the rotation of the rotatable guide blades 15 about their center of rotation 16, the gap cross-section 17 can be varied between two adjacent guide blades 15, whereby the effective turbine cross-section can be variably adjusted. In FIG. 3, the gap cross-section 17 is shown reduced to a minimum. As the result, the effective turbine cross-section is also minimal whereby the variable turbine geometry takes up its ram position.

According to an expedient further development, the turbine size is optimally adapted to the used internal-combustion engine in order to permit high engine braking powers at relatively load thermal loads. For this purpose, a turbo braking factor TBF is defined which is computed according to the relation $$TBF=A_{T,h}*D_T/V_H$$

from the free flow cross-section $A_{T,h}$ in the exhaust gas path to the turbine at the maximal brake power (the hard braking adjustment), the inlet diameter $D_T$ of the turbine wheel and the displacement $V_H$ of the internal-combustion engine. For small exhaust gas turbochargers, which are preferably used in passenger cars and in motorcycles, the turbo braking TBF is at a value smaller than 2%. The value may optionally be lower than 0.5%. For larger engines, particularly for heavy utility vehicles, the turbo braking factor is in the range of less than 5%, preferably in the range of between 1% and 3%.

In small engines, space requirements may dictate elimination of separately constructed brake valves. In the engine braking operation, the outlet valves of the cylinders are operated by the charge cycle valve control provided for the fired driving operation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An engine braking process for a supercharged internal-combustion engine which has an exhaust gas turbocharger with a turbine with a variable turbine geometry which can be adjusted between a ram position with a minimum possible turbine cross-section and an opening position with a maximum turbine cross-section, comprising the steps of defining a permissible turbine cross-section band width within the range between the ram position and the opening position for adjustment of the variable turbine geometry, bounding the turbine cross-section band width by a hard braking adjustment and a soft braking adjustment to represent definable limit values, situating the hard braking adjustment between the ram position and a drive starting position associated with a fired drive operating mode, situating the soft braking adjustment between the drive starting position and the opening position, whereby in the drive starting position, the turbine geometry in the fired drive operating mode assuming a minimum cross-section, and reaching the engine braking power maximum in the hard braking adjustment.

2. The engine braking process according to claim 1, wherein the drive starting position is situated in an engine braking performance adjusting path curve in an area of largest gradient of the curve between the engine braking power maximum and an engine braking power minimum.

3. The engine braking process according to claim 1, wherein in the soft braking adjustment, a lower engine braking power is reached than in the ram position of the variable turbine geometry.

4. The engine braking process according to claim 3, wherein the drive starting position is situated in an engine braking performance adjusting path curve in an area of largest gradient of the curve between the engine braking power maximum and an engine braking power minimum.

5. The engine braking process according to claim 1, wherein in the soft braking adjustment, engine braking power maximally amounts to 50% of engine braking power achievable in the hard braking adjustment.

6. The engine braking process according to claim 5, wherein the drive starting position is situated in an engine braking performance adjusting path curve in an area of largest gradient of the curve between the engine braking power maximum and an engine braking power minimum.

7. The engine braking process according to claim 6, wherein in the soft braking adjustment, a lower engine braking power is reached than in the ram position of the variable turbine geometry.

8. The engine braking process according to claim 1, wherein an adjusting path for adjusting the variable turbine geometry between the hard braking adjustment and the drive starting position is equal to an adjusting path for adjusting the variable turbine geometry between the starting position to the soft braking adjustment.

9. The engine braking process according to claim 8, wherein the drive starting position is situated in an engine braking performance adjusting path curve in an area of largest gradient of the curve between the engine braking power maximum and an engine braking power minimum.

10. The engine braking process according to claim 9, wherein in the soft braking adjustment, a lower engine braking power is reached than in the ram position of the variable turbine geometry.

11. The engine braking process according to claim 10, wherein in the soft braking adjustment, engine braking power maximally amounts to 50% of engine braking power achievable in the hard braking adjustment.

12. The engine braking process according to claim 1, wherein the variable turbine geometry is configured to be manually adjustable between the hard and the soft braking adjustment.

13. The engine braking process according to claim 12, wherein the variable turbine geometry is configured to be automatically adjustable between the hard and the soft braking adjustment as a function of at least one of detected engine condition variables and operating variables.

14. The engine braking process according to claim 13, wherein one of the variables is road inclination.

15. The engine braking process according to claim 13, wherein one of the variables is thrust which acts upon the vehicle.

16. The engine braking process according to claim 15, wherein one of the variables is road inclination.

17. The engine braking process according to claim 13, wherein one of the detected variables is vehicle deceleration.

18. The engine braking process according to claim 13, wherein one of the detected variables is wheel brake temperature.

19. The engine braking process according to claim 1, wherein the variable turbine geometry comprises guide baffles with rotatable guide blades.

20. The engine braking process according to claim 1, further comprising the step of determining a turbo braking factor TBF relative to the engine braking operation at an engine braking power maximum according to the relationship $$TBF=A_{T,h}*D_T/V_H$$

$A_{T,h}$ is the hard braking adjustment $D_T$ is the inlet diameter of the turbine wheel $V_H$ is the displacement of the internal-combustion engine, whereby the turbo braking factor TBF in utility vehicles is lower than 0.005 (5%), and in passenger cars and motorcycles is lower than 0.002 (2%).

21. The engine braking process according to claim 20, wherein the turbo braking factor TBF is lower than 0.0005 (0.5%).

22. The engine braking process according to claim 1, further comprising the step when the engine brake is activated, of operating outlet valves of the internal combustion engine cylinders by a charge cycle valve control provided for the fired driving operation.

* * * * *